US007104383B1

(12) United States Patent
Saltsov et al.

(10) Patent No.: US 7,104,383 B1
(45) Date of Patent: Sep. 12, 2006

(54) VALIDATOR WITH REMOVABLE FLASH MEMORY

(76) Inventors: Leon Saltsov, 7905 Bayview Avenue, Apt. 920, Thornhill, Ontario (CA) L3T 7N3; Gennadiy Gaponyuk, 52 Mabelle Avenue, Apt. 515, Toronto, Ontario (CA) M9A 4X9

( * ) Notice: Subject to any disclaimer, the term of this patent is extended or adjusted under 35 U.S.C. 154(b) by 1293 days.

(21) Appl. No.: 09/503,122

(22) Filed: Feb. 14, 2000

(51) Int. Cl.
*G07F 7/04* (2006.01)

(52) U.S. Cl. ..... 194/206; 194/207; 209/534

(58) Field of Classification Search ..... 194/206, 194/217, 207
See application file for complete search history.

(56) References Cited

U.S. PATENT DOCUMENTS 5,557,518 A * 9/1996 Rosen ..... 235/375
5,774,553 A * 6/1998 Rosen ..... 235/379
5,799,087 A * 8/1998 Rosen ..... 235/379
5,909,502 A 6/1999 Mazur
5,909,794 A * 6/1999 Molbak et al. ..... 194/216
5,940,623 A * 8/1999 Watts et al. ..... 453/31
5,947,255 A * 9/1999 Shimada et al. ..... 194/207
5,964,336 A * 10/1999 Itako et al. ..... 194/207
6,012,565 A 1/2000 Mazur
6,024,288 A * 2/2000 Gottlich et al. ..... 235/380
6,039,645 A * 3/2000 Mazur ..... 453/10
6,044,952 A * 4/2000 Haggerty et al. ..... 194/207
6,079,018 A * 6/2000 Hardy et al. ..... 713/170
6,142,284 A * 11/2000 Saltsov ..... 194/207
6,142,285 A * 11/2000 Panzeri et al. ..... 194/328
6,233,566 B1 * 5/2001 Levine et al. ..... 705/36
6,241,069 B1 * 6/2001 Mazur et al. ..... 194/207
6,301,344 B1 * 10/2001 Meyer et al. ..... 379/143
6,318,536 B1 * 11/2001 Korman et al. ..... 194/217
6,334,190 B1 * 12/2001 Silverbrook et al. ..... 713/200

* cited by examiner

*Primary Examiner*—Gene O. Crawford
*Assistant Examiner*—Jeffrey A. Shapiro

(57) ABSTRACT

A banknote validator includes a banknote processing channel, a series of sensors located along the channel for scanning a banknote as it moves past the sensors, a central processing unit for controlling the operation of the validator and receiving and processing the signals from the sensors. A removable memory storage arrangement is insertable in a receiving location of the validator. The removable memory storage arrangement, when received in the receiving location, forms an electrical communication path with the central processing unit and provides to the central processing unit the logic for operating the validator. Preferably, the removable memory storage arrangement is a serial flash module having its own electronic address used by the validator to confirm the encoded software being downloaded to the validator has not been tampered with. As a further preferred security feature the validator is designed such that it will only operate when a removable flash module is received in the validator.

15 Claims, 5 Drawing Sheets

FLASH CARD MEMORY SPACE

| |
|---|
| MANUFACTURER ID |
| PART COMPABILITY |
| PACKAGE SPEED |
| TEMP.,VOLTAGE |
| RESERVED |
| CHECKSUM MSB |
| CHECKSUM LSB |
| RESERVED |
| SERIAL NUMBER –once programmed memory field |
| SOFTWARE VERSION |
| CHANGEABLE PART OF MAIN PROGRAMM FOR DOWNLOAD |
| |

FIG. 3

MAIN CONTROLLER MEMORY SPACE

| |
|---|
| MAIN PROGRAMM |
| LOADER FOR AUTOMATIC DOWNLOAD |
| SECURITY SOFTWARE MANAGER |
| SECURITY DECODER AND INTERNAL FLASH PROGRAMMER |

FIG. 4

FLASH MEMORY CARD INTERFACE WORKING ALGORITHM

VALIDATOR WITH REMOVABLE FLASH MEMORY

BACKGROUND OF THE INVENTION

The present invention relates to validators and in particular, relates to validators having a removable flash memory module.

A host of different types of validators receive and process banknotes to determine the authenticity thereof. The banknotes are moved past sensors which evaluate different properties of the banknotes and the sensed properties of the banknotes are compared relative to a predetermined standard maintained in memory of a central processing unit of the validator. Based on this comparison a prediction as to the authenticity of the banknote is made.

The cost of a validator typically increases as the number of properties being sensed increases and the degree of precision increases. A compromise is normally made between the degree of accuracy a validator must meet and the percentage of bills being rejected on average. As the degree of accuracy increases, the variation between the properties of the sensed bill and the standard decreases. This typically results in some authentic bills being rejected by the validator. For example, an authentic bill may be somewhat worn and the validator may reject it.

A further factor is the introduction of new banknotes by different governments. To a certain extent this practice is to reduce and deter fraudulent activities. Unfortunately this renders existing validators obsolete or only suitable for processing some banknotes. Under these circumstances, it is desirable to replace the software used by the central processing unit in determining whether bills are authentic.

To alter the software used by a central processing unit of a validator, a skilled technician downloads new software to the central processing unit typically from a portable computer. This process is both expensive and time consuming. It would be desirable to provide a more practical approach for updating validators while still providing a high level of security against fraudulent activities.

SUMMARY OF THE INVENTION

A banknote validator according to the present invention comprises a banknote processing channel, a series of sensors located along the channel for scanning a banknote as it moves past the sensors, a central processing unit for controlling the operation of the validator and receiving and processing the signals from the sensors. The validator includes a removable memory storage arrangement insertable in a receiving location of the validator. The removable memory storage arrangement, when received in the receiving location, forms an electrical communication path with the central processing unit and provides to the central processing unit the logic for operating the validator.

According to an aspect of the invention, the removable memory storage arrangement is a serial flash module.

According to yet a further aspect of the invention, the removable memory storage arrangement includes an electronic address available to the central processing unit and the electronic address is used to confirm the encoded software remains unchanged.

According to yet a further aspect of the invention, the serial flash module contains information to be downloaded to the central processing unit for controlling the operation of the validator. As a security feature the central processing unit of the validator will not allow the validator to operate if a serial flash memory module is not inserted therein.

According to yet a further aspect of the invention, the removable flash module contains encrypted algorithms used by the central processing unit to evaluate banknotes for authenticity and the central processing unit includes decryption software for using the algorithms. In this way, the information contained in the removable memory storage arrangement is not easily available for misuse.

According to a further aspect of the invention, the serial flash module includes a read only memory which includes an identification code specific to the serial flash memory module and a rewritable memory containing encrypted operating software for operating the validator, said encrypted software including encryption of at least part of said identification code, and the validator includes encryption software for decoding said operating software for use by said validator, said validator providing a security check by comparing the at least part of the identification code which has been decoded with said identification code in said read only memory and only operates when a match is present.

The present invention is also directed to a method of updating software used by a validator in assessing banknotes and to a removable memory arrangement for upgrading a validator.

BRIEF DESCRIPTION OF THE DRAWINGS

Preferred embodiments of the invention are shown in the drawings, wherein:

FIG. 3 shows allocated memory space of the flash memory module;

FIG. 4 illustrates allocated memory of the controller of the CPU;

DETAILED DESCRIPTION OF THE PREFERRED EMBODIMENTS

Figure 1:
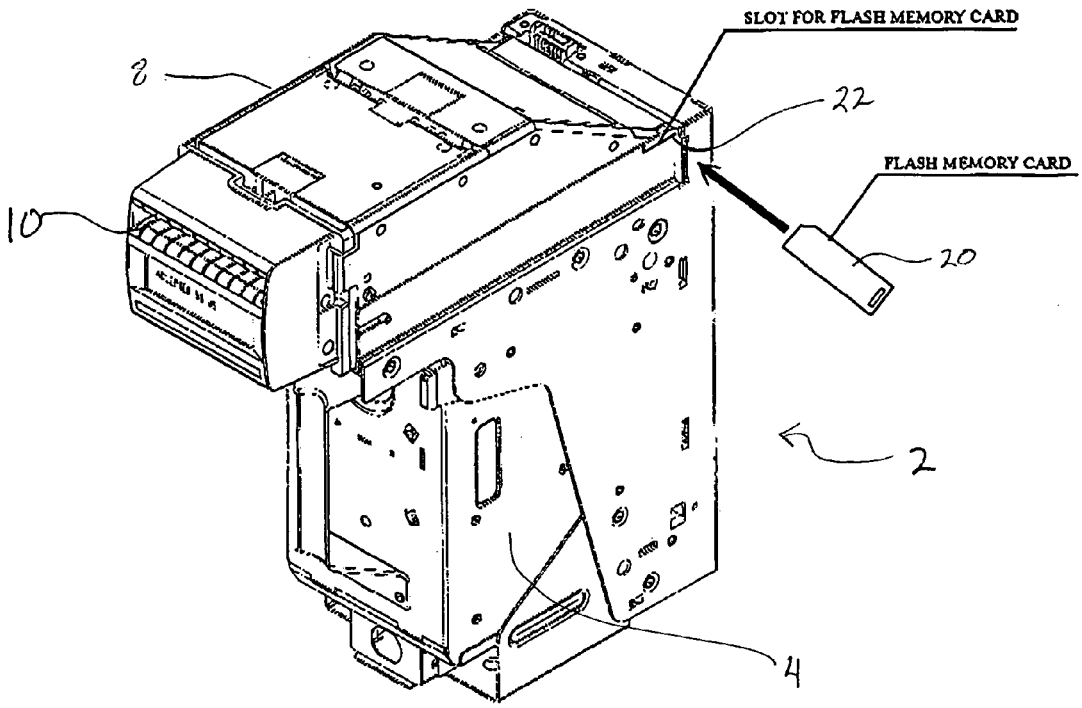
FIG. 1 is a perspective view of a validator with a removable flash memory module.

The validator 2 shown in FIG. 1 includes a removable cassette 4 receives and stacks banknotes which have been processed by the banknote processing unit 8. The banknote processing unit includes a pathway for advancing a banknote from the entry slot 10 to the removable cassette 4. Sensors are located along the pathway for scanning the banknote and the signals from the sensors are fed to a central processing unit of the validator.

The validator includes a receiving slot 22 for receiving the removable flash memory module 20. There are several different manufacturers of flash memory modules. One such flash memory module is NX25F011 sold by NexFlash.

These serial flash modules are available in various capacities and the common capacities today are between 128 KB–4 MB. They are quite small in size and have fast data transfer rates. This flash memory module has a simple interface with four or eight PIN contact. Information which is to be downloaded to the central processing unit (CPU) of the validator is encrypted in the removable flash memory module and is therefore difficult to access and/or corrupt.

The flash memory module 20 is divided into two distinct segments namely a read only memory and a rewritable memory. The read only memory is used by the manufacture to assign an identification code to each module. Preferably this identification code uniquely identifies the module. As this portion of the module is a read only memory it can not change. The rewritable memory is available to users to record information and in this case is used for recording encrypted software used by the validator banknote evaluation. The encrypted software also includes encryption of at least part of the identification code as a safe guard against tampering as will be more e fully explained.

When the flash memory module 20 is inserted into a validator, the CPU communicates to the flash memory module through the serial interface 40. As part of an initial communication, the CPU obtains the identification code of the module from the read only memory. In addition the CPU obtains the encrypted software. The CPU includes the capability to decode the encrypted software and carries out this function. This includes decoding and identification of the identification code or part thereof that was encrypted in the software being downloaded. This code is checked for a match with the code in the read only memory. If there is agreement it is assumed the software is authentic and has not been exposed to corruption.

With this arrangement corruption of a removable memory module is extremely difficult. The software is encrypted and includes an encrypted identification somewhere therewithin. Corruption requires decoding and the security level can be very high. Duplication of the entire sensor module is difficult due to the read only memory. Even if this was possible the module would still provide authentic software to be used for validation. The validator is designed to only function when a memory module is present such that updating of several validators requires an equal number of new memory modules.

Figure 2:
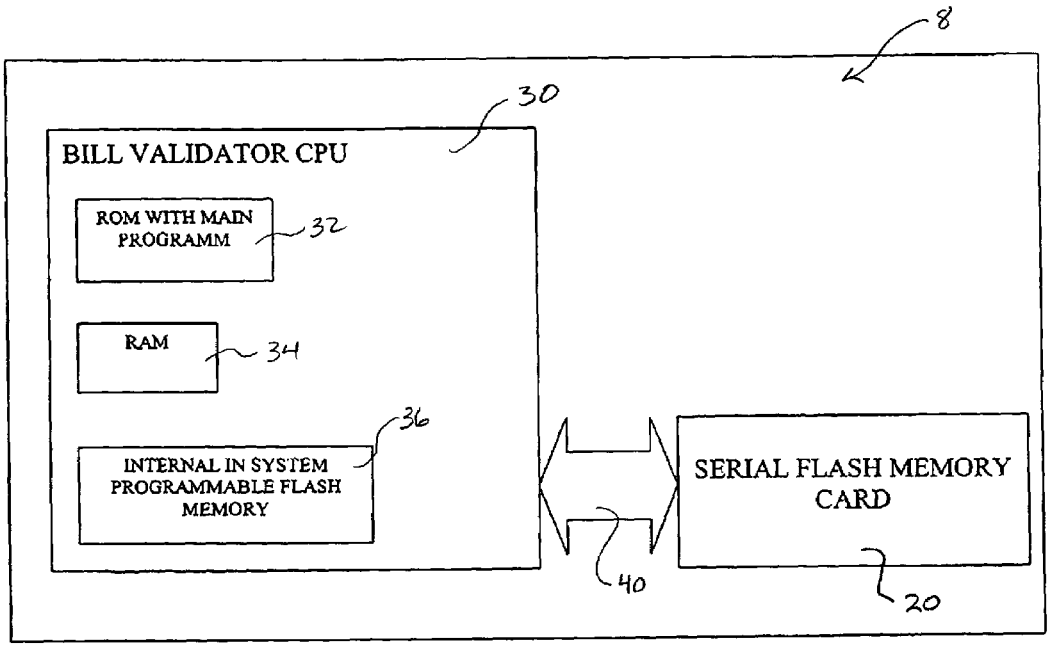
FIG. 2 is a schematic view of part of a bill validator, and in particular, the cooperation of the central processing unit of a validator and the removable flash memory module.

As shown in FIG. 2, the validator has a central processing unit 30 which includes a Read Only memory which maintains the main program of the validator. This would include software for downloading information from the flash memory module, security software, decoder and an internal flash programmer. The software contained in the Read Only memory 32 cannot change. The CPU also includes a Random Access Memory 34 as well as the internal programmable flash memory 36. This memory contains information for security and ID features and software and algorithms for evaluating currency. This is the information which changes to update the validator.

The serial flash memory module 20 includes new processing software for use by the validator. When the serial flash memory module 20 is inserted into the slot 22, it forms a connection with the serial interface 40 and cooperates with the CPU 30. The main program of the CPU associated with the Read Only memory 32 controls the downloading of the software from the flash memory module 20 to the internal flash memory 36 and includes decoding of the information being downloaded and the security check.

Figure 5:
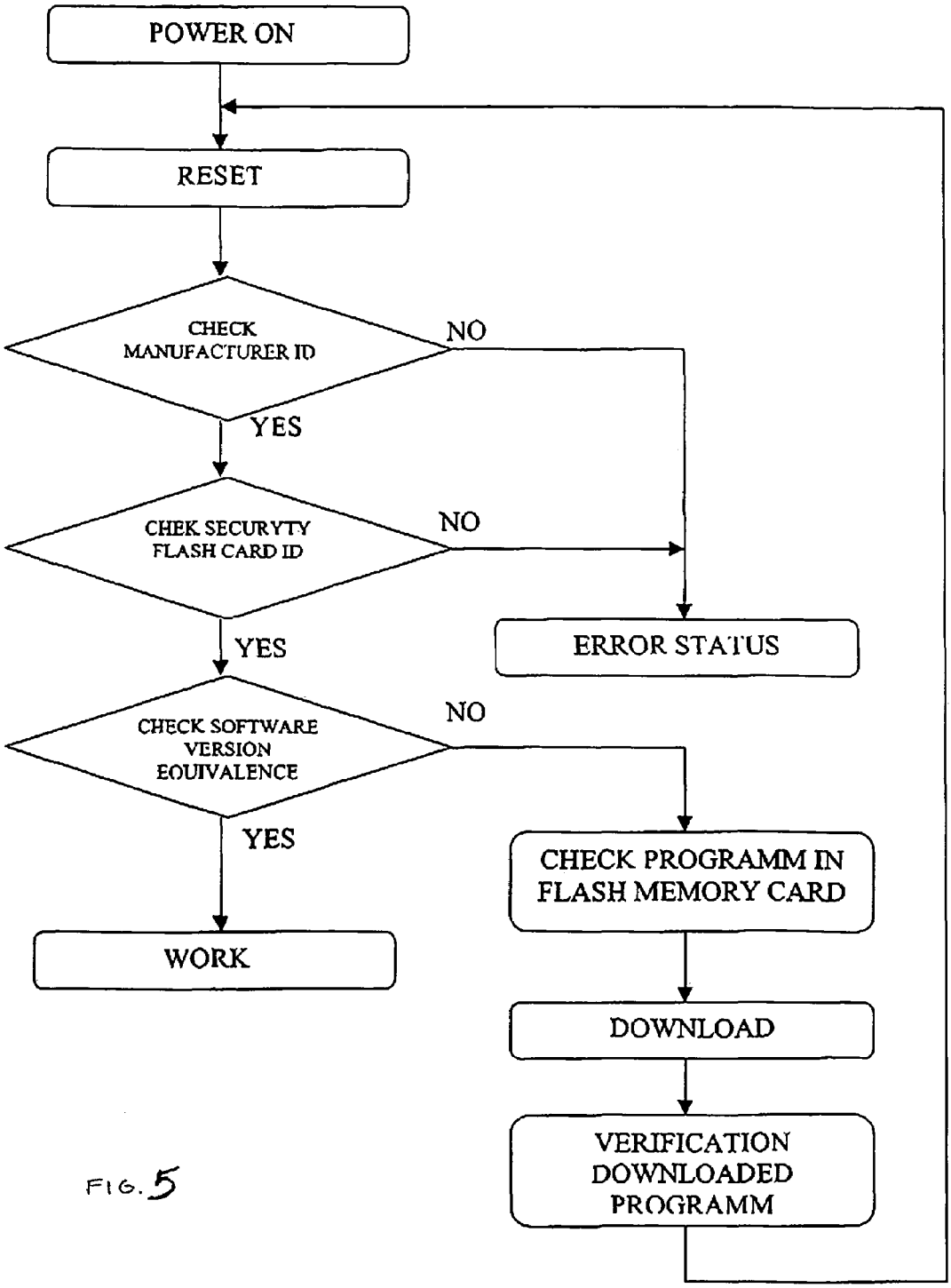
FIG. 5 is a flow chart of the algorithm used by the validator during startup.

When the validator is turned on, as shown in FIG. 5, the main program in the read only memory 32 causes the central processing unit to check and determine whether the flash memory module 20 is inserted into the validator and whether it has the correct ID and whether it is error free. The CPU maintains its own copy of the unique identification code of the serial module which is compared with the identification code of the read only memory of the module. If the program in the CPU flash memory 36, and the serial flash memory of the module 20, contain the same version of the software, the validator starts to function. This would be the case if the validator has previously received the serial flash memory module 20 and has downloaded the software of the module to the internal flash memory 36. If the flash memory has been inserted into the validator for updating of the validator, the CPU and the removable flash memory cooperate to download the program from the module to the flash memory of the CPU. The data from the serial flash memory module is decoded and used to program the internal CPU flash memory 36. If the serial flash memory module 20 is not present, the validator will produce an error message and will not process banknotes.

When a flash memory module is first inserted into a validator, a communication sequence or exchange occurs between the CPU and the flash memory module. The serial number or other unique information of the memory module is read by the CPU from the read only memory of the flash memory module and stored in the CPU. The CPU then downloads and decodes the encrypted software and performs the security check with respect to the identification code which was also encoded. If all steps are satisfactory the validator has been updated and will function with the updated software.

If the memory module is removed and inserted in a different validator a similar process will occur. The original validator will not function until a memory module is inserted therein and will go through the process again.

With the above arrangement where the flash memory module becomes a necessary part of the validator for operation thereof. In this way, the software is controlled in an effective manner and appropriate software for each validator is required. Furthermore, the information contained in the flash memory module is encrypted, and therefore, it is not possible to easily determine the controlling software used by the validator. The validator includes its own encryption software to allow decoding of information downloaded to the validator from the flash memory module.

As can be seen in FIG. 3, the flash memory module has the memory thereof, divided into a number of segments, many of which are associated with security features. Similarly, the CPU has a different memory, as indicated in FIG. 4.

Returning to the flow chart of FIG. 5, upon power up, the CPU runs a self check with respect to the cooperation between the central processing unit and the flash memory module. The CPU obtains from the flash memory module, a manufacturer ID. If this is confirmed, then the next step is to check the security flash memory module ID and subsequently check the software version to confirm they are the same. If the manufacturer ID or the flash module ID are in disagreement, an error status report is generated. If there is a difference in the software version, then the CPU cooperates with the flash memory module to download the new program to the flash memory of the CPU. After this step, it goes through a verification program and returns the system to a start up situation, for verification. This verification should result in the validator working as the program has been updated.

As can be appreciated form the schematics of FIGS. 3 and 4 some information such as software version can be part of the rewritable memory and may not be encoded. Therefore The rewritable memory may include both non encoded and encoded information (operating software). All of the information can be encoded if desired.

The operating software of the memory module is preferably downloaded to the internal flash memory of the validator.

With this system, the CPU of the validator, can at the time of manufacture, include in a secure manner, the necessary programming and logic which will allow updating thereof by downloading information from the flash memory module. It is initially provided with its own removable flash memory module and could operate for its entire useful life without any updating. On the other hand, if it is found that it is necessary to update the validator to increase the security features thereof, or to allow the validator to detect new banknotes, the programming of the validator can be updated.

This is accomplished by sending to the owner, or otherwise providing at the validator, a new flash memory module, and replacing the existing flash memory module with the new module. The validator is then turned on and goes through its own logic sequence to download the new program to the validator. It also writes certain information to the flash memory module, such that flash memory module cannot be used with other validators. As can be appreciated, the validator effectively carries out the downloading and the verification sequences when a new module is inserted, and therefore, this can be accomplished by an unskilled, authorized person. It does not require a skilled technician nor does it require special tools or other expertise. These flash memory modules, once programmed, can be sent by mail to the owner of the validators and he can arrange for updating by any one who is familiar with the units, such as someone who is servicing the validators to remove banknotes stacked in the cassette. This arrangement provides full security with the ease of convenient updating.

Figure 6:
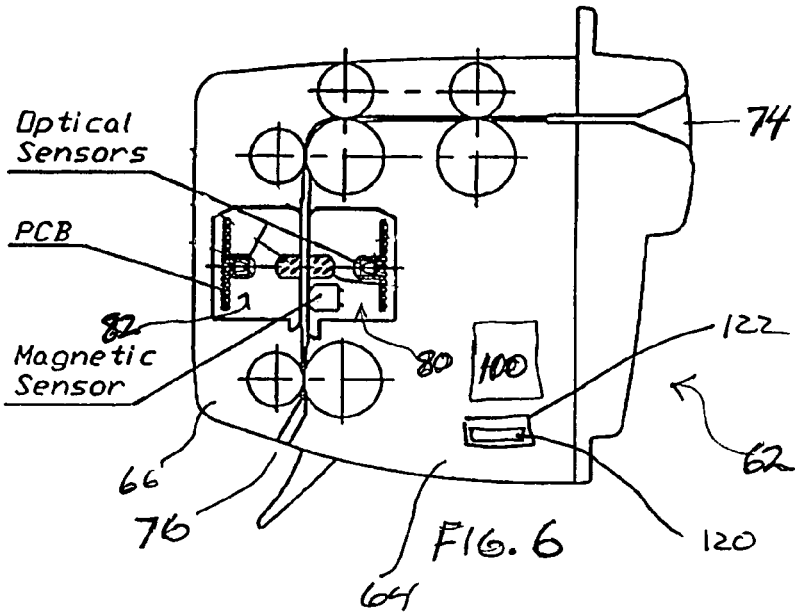
FIG. 6 shows a validator with a removable sensor module.
Figure 7:
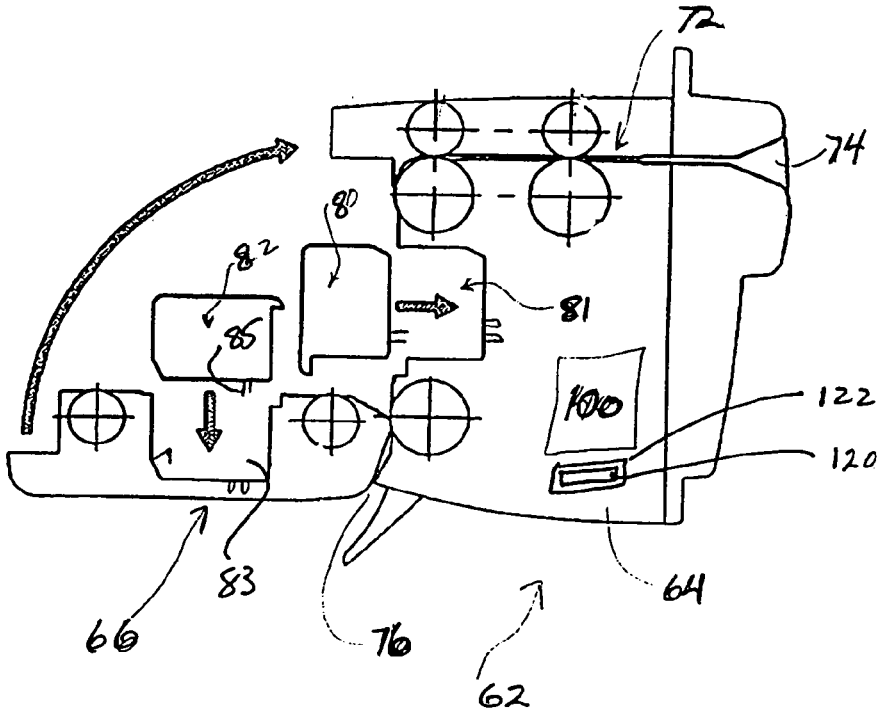
FIG. 7 shows the validator of FIG. 6 in a service position with the sensor modules about to be inserted.

Another feature of the invention is the ease of programming the validator by the manufacturer. The programming by the sensor module also allows ease in changing from one currency to another. The validator can include removable sensor modules as shown in FIG. 6 and FIG. 7 allowing the type and location of the sensors to easily change by replacing one sensor module with a different sensor module. The programming for determining authenticity can change by changing the memory module. Sensor modules of different types and memory modules of different types can be maintained in stock and only associated with a validator when a particular order is received. This reduces inventory and also reduces problems associated with obsolete stock caused by new processing software and/or improved sensor modules.

The validator 62 of FIGS. 6 and 7 includes a two part housing comprising a fixed part 64 and a pivoting part 66. FIG. 6 shows the operating position and FIG. 7 shows an open service position. Banknotes are inserted in slot 74 and advanced past the removable sensor modules 80 and 82. These modules are positioned on opposite sides of the scanning path 72 and form part of the walls of the scanning path. The fixed part of the housing includes the CPU 100, the removable memory receiving slot 122, and the removable flash memory module 120. An accepted banknote is feed to a stacking cassette through the discharge outlet 76.

The sensor modules are located in recesses 81 and 83 to opposite sides of the path. Each sensor module includes an electrical connection 85 for connection with an electrical connection of the validator. As shown in FIG. 6 each sensor module can have multiple sensors and preferably the module converts the sensor signals to digital signals feed to the CPU. The validator of FIGS. 6 and 7 have the advantage of fast modification with respect to both sensors and processing software. This allows the validator to be of a general design and convertible to a particular application and currency by choosing the appropriate sensor modules and programming software when the actual application is known.

The removable memory module can cooperate with the CPU of the validator in other ways. For example the CPU can personalize the removable memory module such that it can not be used with other validators once it has been used to update a particular validator. The flash memory module 20 can include a writable address which is written to by the validator to personalize the module to the validator. When the flash memory module 20 is inserted into a validator, the CPU communicates to the flash memory module through the serial interface 40. As part of an initial communication, the CPU writes to the writable address of the flash memory module, the serial number of the CPU and the flash memory maintains this address as a one time write memory. As such this information can not be changed or over written. This arrangement is particularly advantageous in that the serial flash memory module, once inserted in an appropriate validator, has the serial number of that validator written to the flash memory module.

The interaction between the CPU and the flash memory module is such that the flash memory module cannot be used for updating other validators. It is also possible to have the CPU write to this one time writable memory once updating of the CPU has been completed successfully. In this way the memory module is not limited to a particular validator until the validator has been updated. The CPU is programmed to look to this writable memory upon insertion of the module and confirm it has not been used to update a different validator.

When a flash memory module is first inserted into a validator, a communication sequence or exchange occurs between the CPU and the flash memory module. The serial number or other unique information of the validator is forwarded from the CPU to the flash memory module and stored in a one time writable address associated with the flash memory module. This step then dedicates that particular flash memory module to that particular validator. If that flash memory module is removed and inserted in a similar type validator, the CPU of the second validator will start an initial communication with the flash memory module and it will be determined that the identity of that second validator is not the same as the address or code which has been written into the writable area of the flash memory module. This recognition will then stop any downloading of information and result in an error message.

A further feature of the system is that the validator will not function without the flash memory module 20.

The personalizing of the memory module to a validator provides additional control on the use of the memory module and provides additional control for the manufacturer as the updates are being carried out to a large extent outside of his control. Updating of each validator requires a new memory module and therefore some control is returned to the manufacturer.

This feature of rendering the memory module dedicated to a particular validator can be used in combination with the security feature associated with the serial number of the memory module and the encrypted software previously described.

In some cases the updated validator can benefit form having additional memory capacity available to it for the normal operation thereof. The removable memory arrangement can have additional capacity over and above that needed for software to be downloaded which is available to the CPU. It is also possible, although not preferred to delete the dwonloaded software and thus make this memory space available. This modification would also require modification of the initial power up procedure of the validator.

Although various preferred embodiments of the present invention have been described herein in detail, it will be appreciated by those skilled in the art, that variations may be made thereto without departing from the spirit of the invention or the scope of the appended claims.

The invention claimed is:

1. A banknote validator comprising a banknote processing channel, a series of sensors located along said channel for scanning a banknote as it moves past said sensors, a central processing unit for controlling the operation of said validator and receiving and processing the signals from said sensors, and a removable memory storage arrangement insertable in a receiving location of said validator, said removable memory storage arrangement when received in said receiving location forming an electrical communication path with said central processing unit, said central processing unit including a testing procedure which evaluates the integrity of any received removable memory storage arrangement and said central processing unit downloading information from said received removable storage arrangement for operation thereof upon positive evaluation of the integrity of said removable memory storage arrangement and wherein the removable memory storage arrangement includes an electronic address available to the central processing unit and the electronic address is used as part of said testing procedure and wherein the removable memory storage arrangement contains encrypted algorithms used by the central processing unit to evaluate banknotes for authenticity and the central processing unit includes decryption software for decoding the algorithms and storing the decoded algorithms in said central processing unit.

2. A banknote validator as claimed in claim 1 wherein said removable memory storage arrangement is a serial flash memory module.

3. A banknote validator as claimed in claim 1 wherein the removable memory storage arrangement includes an electronic address available to the central processing unit and the electronic address is used as part of said testing procedure.

4. A banknote validator as claimed in claim 2 wherein said central processing unit of the validator will not allow the validator to operate if the central processing unit has previously downloaded information from a serial flash memory module and a serial flash memory module is not received in said validator.

5. A banknote validator as claimed in claim 3 wherein the removable flash memory module contains encrypted algorithms used by the central processing unit to evaluate banknotes for authenticity and the central processing unit includes decryption software for decoding the algorithms and storing the decoded algorithms in said central processing unit.

6. A serial flash memory module for updating a validator comprising a read only memory which includes an identification code specific to the serial flash memory module and a rewritable memory containing encrypted operating software for operating a validator, said encrypted software including encryption of at least part of said identification code.

7. A banknote validator as claimed in claim 3 wherein said removable memory storage arrangement provides additional memory available to said central processing unit for evaluation of banknotes.

8. A banknote validator as claimed in claim 1 wherein said removable memory storage arrangement contains encrypted algorithms used by the central processing unit to evaluate banknotes for authenticity.

9. A banknote validator as claimed in claim 1 wherein said validator includes an electronic address available to said central processing unit, and said removable memory storage arrangement includes a memory location for storing the electronic address of the validator when received in said removable storage arrangement.

10. A banknote validator as claimed in claim 2 wherein said serial flash memory module contains information to be downloaded to said central processing unit for controlling the operation of said validator, said serial flash module after downloading of said information including a security feature such that said serial flash module can not be used with other validators.

11. A banknote validator as claimed in claim 9 wherein said serial flash memory module records the electronic address of the validator when received in said receiving arrangement and only communicates with said central processing unit when there is a match between the recorded electronic address and the electronic address provided by the validator.

12. A banknote validator as claimed in claim 1 wherein said removable memory storage arrangement provides additional memory available to said central processing unit for evaluation of banknotes.

13. A banknote validator as claimed in claim 2 wherein said removable memory storage arrangement contains encrypted algorithms used by the central processing unit to evaluate banknotes for authenticity.

14. A method of updating the criteria used to evaluate the authenticity of banknotes by a banknote validator having a banknote processing channel, a series of removable sensor modules located along said channel for scanning a banknote as it moves past said sensor modules, a central processing unit for controlling the operation of said validator and receiving and processing the signals from said sensor modules, and a receiving location for receiving a removable memory storage arrangement and allowing communication between said central processing unit and a received removable memory storage arrangement, said central processing unit including a testing procedure which evaluates the integrity of any received removable memory storage arrangement, said method comprising inserting a removable memory storage arrangement in said receiving arrangement and communicating with said central processing unit, conducting said test procedure using information provided to said central processing unit by said removable memory storage means to confirm the integrity thereof, and in response to confirmation of the integrity of said removable memory storage arrangement downloading information contained in said removable memory storage arrangement to said central processing unit thereby updating the criteria used to evaluate banknotes processed by the validator and including the step of replacing at least one sensor module with a new sensor module and wherein said central processing unit is updated to process the signal of said at least one new sensor module using said downloaded information.

15. A method as claimed in claim 14 including the step of replacing at least one of the sensor modules with a new sensor module and wherein said central processing unit is updated to process the signal of said at least one new sensor module using said downloaded information.

* * * * *